United States Patent [19]

Gooding

[11] 4,074,680

[45] Feb. 21, 1978

[54] TELESCOPING HOOD FIREPLACE

[76] Inventor: Marvin Sexton Gooding, P.O. 36D, R.R. #4, Tiffin, Ohio 44883

[21] Appl. No.: 703,877

[22] Filed: July 9, 1976

[51] Int. Cl.[2] ..... F24C 15/20

[52] U.S. Cl. ..... 126/142; 126/143; 126/301

[58] Field of Search ..... 126/142, 120, 143, 123, 126/126, 136, 301, 302, 303, 4, 307, 137, 58, 146, 242; 110/69

[56] References Cited

U.S. PATENT DOCUMENTS

| | | | |
|---|---|---|---|
| 286,643 | 10/1883 | Schwibinger | 126/301 |
| 495,141 | 4/1893 | Norton | 126/301 |
| 1,743,129 | 1/1930 | Gilbert | 110/69 |
| 1,957,921 | 5/1934 | White | 110/7 A |
| 2,444,985 | 7/1948 | Fulton | 126/242 |
| 3,244,164 | 4/1966 | Cooper | 126/58 |
| 3,830,217 | 8/1974 | Maness et al. | 126/120 |
| 3,884,618 | 5/1975 | Neyret | 431/276 |
| 3,910,251 | 10/1975 | Andrew | 126/120 |
| 3,994,274 | 11/1976 | Manno | 126/120 |
| 4,006,733 | 2/1977 | Crownover | 126/143 |

*Primary Examiner*—John J. Camby
*Assistant Examiner*—Larry I. Schwartz
*Attorney, Agent, or Firm*—David H. Semmes; Warren E. Olsen

[57] ABSTRACT

The invention relates to fireplace structures, particularly of the open hearth type, wherein a combustible fuel is subjected to combustion with oxidizing air generally drawn from the space into which the structure opens. The present invention additionally includes an ambient air inlet for drawing air from without the room into which the structure opens, allowing the fireplace to be operated with a telescoping hood in either a raised or lowered position. The present invention further includes a mechanism for raising and lowering a telescoping hood, and a further ash removal mechanism operable to remove products of combustion from the bottom on the fireplace grill to an external point of deposit.

16 Claims, 5 Drawing Figures

FIG. 3
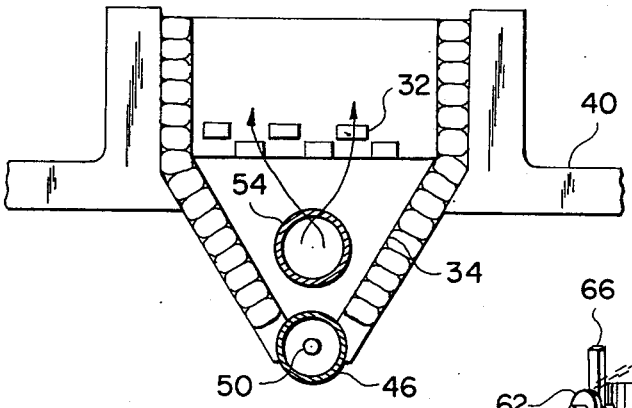
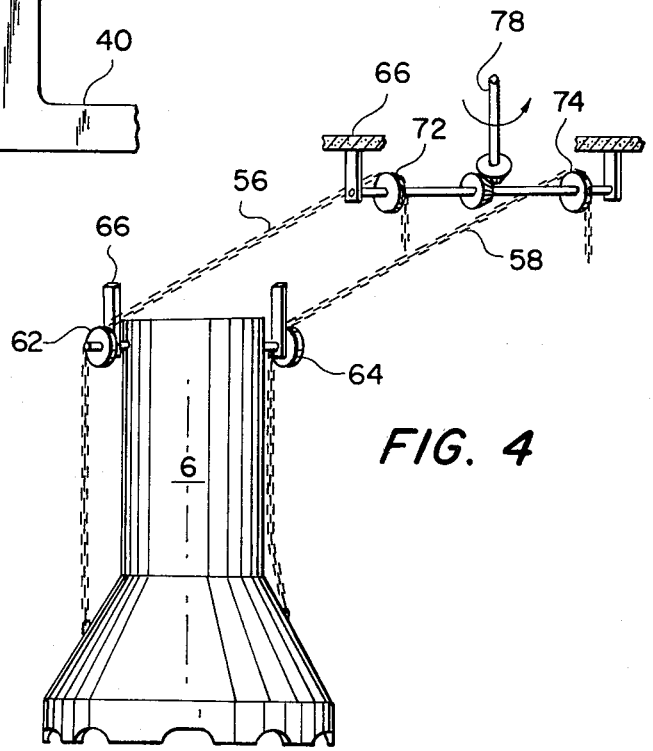
FIG. 4
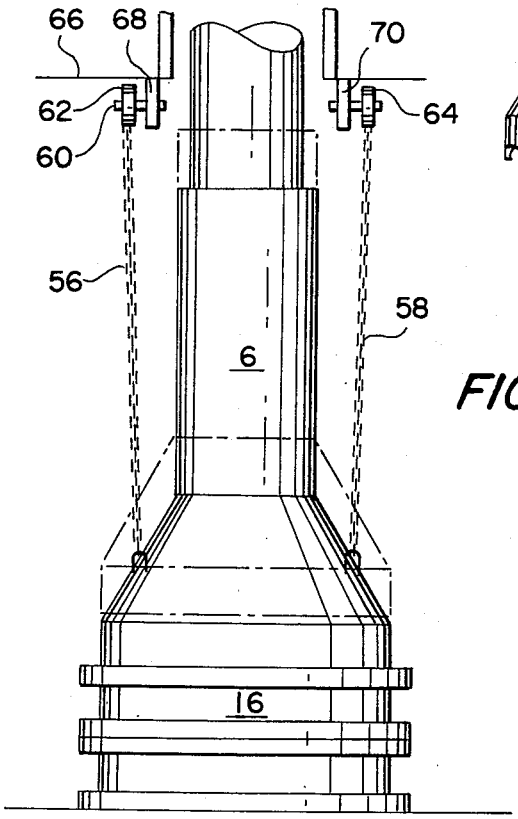
FIG. 5

TELESCOPING HOOD FIREPLACE

BACKGROUND OF THE INVENTION

1. Field of the Invention

The invention relates to fireplace structures, particularly of the open hearth type, wherein a combustible fuel is subjected to combustion with oxidizing air generally drawn from the space into which the structure opens.

2. Description of the Prior Art

Traditional open hearth fireplace structures conventionally employ a stationary hood or flue structure which is fixedly mounted to a portion of the ceiling directly above the hearth. While various and sundry fireplace constructions are known in the prior art, there has not been found a fireplace construction which significantly includes a telescoping fireplace hood, one that is adjustable to suit fire and draft conditions. Exemplary of prior art fireplace designs are the following U.S. Pat. Nos. Andrews, 3,910,251; Galluzzo, 3,888,231; Maness, 3,830,217; Miller, 3,777,735; Hannebaum, 3,499,432; Pyzel, 3,467,738; Durand, 3,431,873; Barber, 2,497,486; Hobson, 2,022,450; Herman, 1,174,980; Wiley, 1,050,892; Watson, 1,050,317.

The patent to Andrews illustrates a free-standing fireplace construction that includes a pedestal base cooled by an ambient air flow. The elements of the Andrews construction are fixed, and do not allow for the hood to be telescoped down over the hearth.

The patent to Galluzzo illustrates an open hearth fireplace having a particular form of room heating structure. The patent to Galluzzo is, again a conventional open hearth design including an ambient air opening from the room in which the structure is located for maintenance of the fire.

The patent to Maness illustrates another form of open hearth design, again, one that does not contemplate a hood which can be selectively lowered upon the hearth itself. The hood in Maness includes a double-wall construction, but is clearly not capable of a function as taught herein. The patent to Miller shows a form of hood which is fixed around an existing building support column, also not lowerable upon the lower conical hearth.

The fireplace taught by Hannebaum includes a natural convention tube for swirling air inside a glass enclosed hearth, together with a stationary hood structure. The patent to Pyzel illustrates a refractory air feeding grate for supplying air from the bottom of a combustion surface.

The patents to Herman and Wiley show grates which will allow for a bottom air feed, but not in combination with a telescoping hood assembly. The patent to Hobson shows a conventional furnace that includes an auger to remove cinders, together with a blower assembly for feeding air underneath a combustion space. The patent to Watson shows another form of updraft furnace, wherein a removable grate has an attached conduit for supplying forced air.

In summary, none of the above patents contemplate a fireplace construction which allows for a telescoping hood to be lowered to any position over a hearth. Additionally, none of the patents include the further feature of a double-wall construction for a telescoping hood, so that combustion products will not leak into the room for any position of the hood relative to the open hearth.

SUMMARY OF THE INVENTION

An improved fireplace according to the present invention comprises a fire support means which is operable to be fixedly supported upon the floor surface in any type of dwelling. The fireplace base is not confined to any particular place within the room, and may be located either centrally or within the corner, or upon a side of the room according to the wishes of the user. The fireplace itself may also function as a grill, and may be centrally located either in a private living room or a commercial establishment for the purpose of grilling meats, for example.

The present invention is significantly characterized by a telescoping hood that is attached to the bottom surface of a stackpipe which will be visible to occupants in the room. According to the preferred embodiment, there is a stationary smoke pipe mounted above and in substantial vertical alignment with the open grill defined within the fireplace base. The stationary smoke pipe extends downwardly from a ceiling mounting point to a point spaced above an upper platform on the fireplace base. The telescoping effect is achieved by a novel interaction of hood design and this stationary smoke pipe. The telescoping hood is positioned for vertical movement upon the downward extension of this stationary smoke pipe where the hood itself includes a novel double-wall construction for communicating with the extending portion of the stationary smoke pipe. The telescoping means further comprises an inner stackpipe concentrically within, and an outer stackpipe concentrically outside the downward extension of the stationary smoke pipe.

At the bottom surfaces of the inner and outer stackpipes, a downwardly open hood extends from the inner stackpipe so that the hood is in sealing engagement with both bottom surfaces of the inner and outer stackpipes. Consequently, the inner and outer stackpipes define an upwardly open double-wall construction which is operable to be adjustably positioned upon the downward extension of the stationary smoke pipe.

A further advantageous feature of the present invention is an upwardly open plenum within the fireplace base. According to the preferred embodiment, the upwardly open plenum is of an inverted conical section, wherein the bottom portion of the plenum communicates with an ambient air conduit. This ambient air conduit supplies air to a top porton of the plenum. The top portion of the plenum further includes a grating means for supporting any form of combustible material, including coal and wood; as well as a manifold for a gaseous fuel such as bottled or natural gas. A further advantageous feature of the present invention is an ash removal means positioned at the lowermost portion of the upwardly opening plenum. This ash removal means is further illustrated in the preferred embodiment to comprise a laterally extending ash conduit, wherein the conduit includes a motor driven auger. This motor driven auger and conduit arrangement may be disposed below the floor surface supporting the fireplace base, so that an upwardly open portion of the conduit may communicate with the lowermost portion of the plenum, to receive ashes from the superposed grating. The grating itself may take on any number of forms; in a preferred embodiment, the grating comprises a plurality of fire brick laterally and vertically spaced to define updraft air passages for ambient air supplied from a bottom portion of the plenum.

The telescoping hood itself may be positioned at any vertical orientation above the upper platform of the fireplace base, without derogation to the operation of the device. The telescoping hood may be placed downwardly upon an upper platform of the fireplace base, wherein all the combustion air for the fire within the hearth is supplied through the ambient air conduit means disposed below the floor, and within the fireplace base itself. When the hood is positioned in this lowered position, a further advantageous feature taught according to the present invention is the provision of a series of apertures around the lower edge of the downwardly open hood. When the lower edge of the telescoping hood is positioned upon an upper surface of the fireplace base, the provision of at least one aperture will allow room air to enter within the hood and cool the inner surface of the hood against the hot gases produced by the combusting material. Therefore, the present invention allows for the telescoping hood to be placed in communication with an upper platform on the fireplace base, without danger that the downwardly extending hood portion will become excessively heated. With the hood in the lower most position, air will travel by natural convection within these apertures, forming a film of cooling air along the inner surface of the downwardly open hood, and up into the inner surface of the inner stackpipe. Due to the sealing engagement of the extending hood with the bottom surfaces of the inner stackpipe and the outer stackpipe, a double-wall construction is defined between the inner and the outer stackpipe. This annular space between the inner and outer stackpipe cooperates with the downward extension of the stationary smoke pipe to define a labryinth seal against the passage of combustion products outside of the smoke pipe, and into the room.

The present invention further teaches a lifting mechanism operable to be located proximate a ceiling of a room containing the present invention. According to the preferred embodiment, the lifting mechanism comprises a pair of chains which are downwardly suspended, diametrically and proximate with respect to the stationary smoke pipe, wherein each chain has a distal end connected externally to the downwardly open hood, and a proximate end connected to a sprocket drive means. The sprocket drive means engages each chain to allow the telescoping hood to be easily raised or lowered into any relative vertical orientation upon the fireplace base. The sprocket drive means is preferably energized by an electric motor, while it may optionally be rotated manually.

Therefore, the present invention has for a significant object the provision of a fireplace grill which will allow a user to operate a telescoping hood in any vertical orientation upon a floor mounted fireplace base, without danger of cutting off air supplied to a fire contained therein.

A further understanding of the principles, objects and advantages of the present invention may be had by reference to the following detailed description of the invention, wherein reference is made to the following drawings.

BRIEF DESCRIPTION OF THE DRAWINGS

FIG. 3 is a sectional view of a firebase, according to a preferred embodiment of the invention;

FIGS. 4 and 5 are schematic representations of a lifting mechanism, according to a preferred embodiment of the invention.

DESCRIPTION OF THE PREFERRED EMBODIMENT

Figure 1:
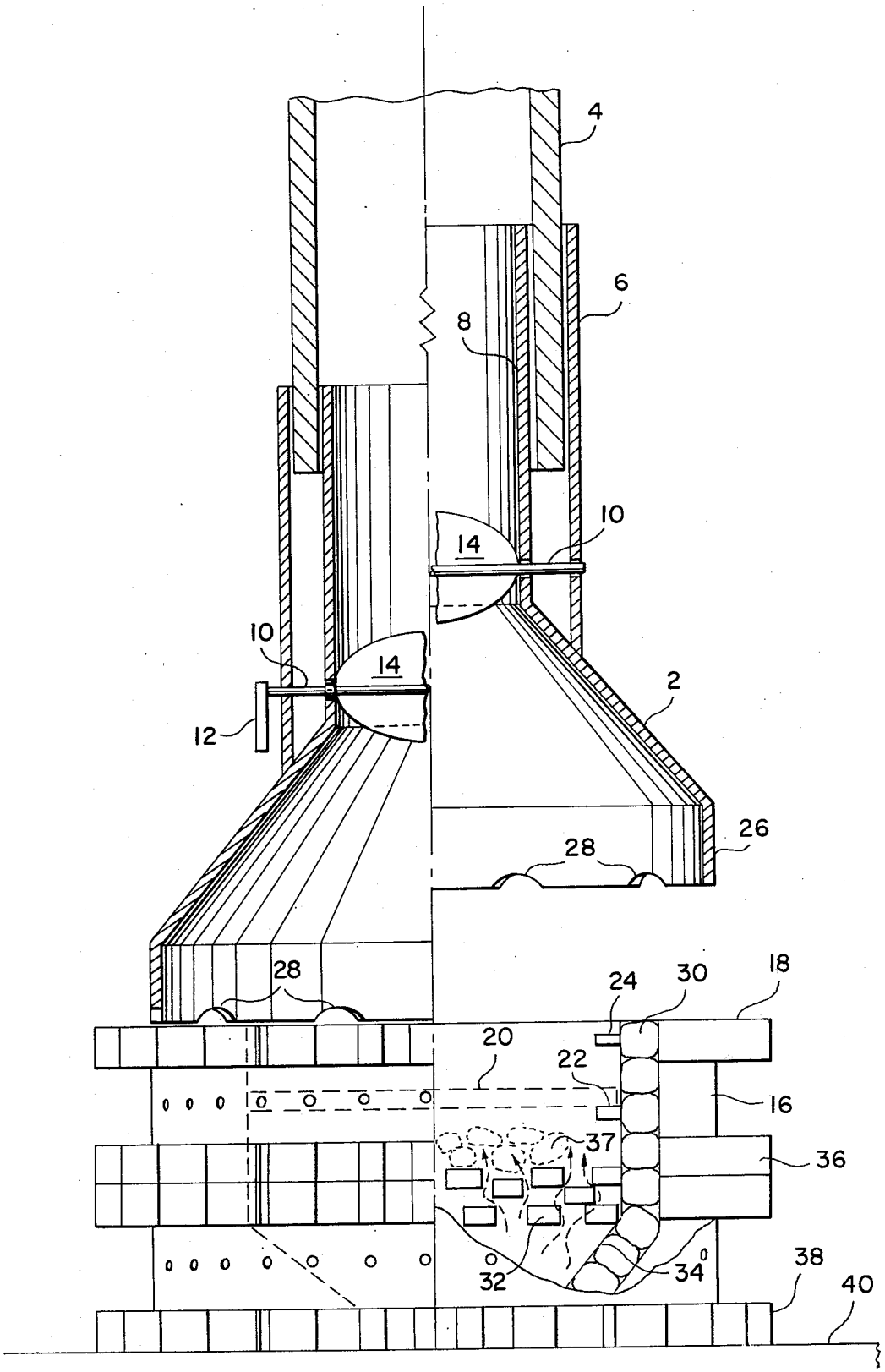
FIG. 1 is a schematic plan view of the invention, showing the hood in two vertical orientations by partial section.

A preferred embodiment is schematically illustrated at FIG. 1, by vertical section to illustrate the basic operating principles. The improved fireplace comprises an adjustable hood 2 which is positioned for a vertical telescoping action upon a stationary smoke pipe 4, wherein the stationary smoke pipe extends downwardly from an upwardly disposed mounting. The stationary smoke pipe is operable to be mounted above and in substantial vertical alignment with a fire support means, broadly shown at 36. The fire support means 36 includes a fireplace base 16 that may have any form of ornamental exterior configuration, including a lowermost base portion 38 for operable mounting of the fireplace base upon a floor surface, shown at 40. While the fire support means 16 is generally illustrated to be cylindrical, any shape, according to the wishes of the user, may be employed without departing from the spirit and scope of the present invention. As illustrated in FIG. 1, the preferred embodiment includes a upwardly opening plenum 34 insulatively spaced within the fireplace base 16 through the provision of a heat resistant lining, such as shown at 30. The lining shown at 30 may be of fire brick or any other thermo insulating material, as is conventionally employed in the fireplace art. The upwardly opening plenum 34 may be considered to have an upper portion for support of any form of combustible material. In FIG. 1, a grating means is illustrated at 32 to further comprise a plurality of fire brick, wherein the fire brick are laterally and vertically spaced to define updraft passages in addition to supporting any form of combustible material, as at 37. The representation at 37 is contemplated to include coal, wool, charcoal versions of the same, as well as a manifold for a gaseous fuel, such as bottled or natural gas. The top portion of the plenum 34 is further illustrated in FIG. 1 to include a grill means 20. The grill means 20 is illustrated to be adjustable at various heights above the combustible material 37, by inwardly extending supports 22 and 24. The fireplace base 16 further includes a generally horizontal upper platform 18 for a purpose which will no be more particularly described. A telescoping hood 2 further comprises an inner stackpipe 8, concentrically within the smoke pipe 4, and an outer stackpipe 6, concentrically outside the stationary smoke pipe 4. The stationary smoke pipe 4 extends downwardly only to a point which is spaced above the upper platform surface 18 of the fireplace base, so that there will be an effective travel allowed for the telescoping hood 2. As illustrated in FIG. 1, the telescoping hood 2 is illustrated in vertical section for two vertical orientations of the hood over the fireplace base. In the left sectional view of FIG. 1, the fireplace hood 2 is shown with a lower edge of the telescoping hood engaging the upper platform surface 18. The lower edge of the telescoping hood 2 is further illustrated, schematically, with a series of apertures 28. This schematic illustration at 28 is intended to represent any form of serrated, or uneven, edge that will allow room air to enter by convection, for the following function. According to this preferred embodiment, providing at least one aperture around the bottom edge of the telescoping hood allows room air to enter within the hood 2 even when the hood is lowered upon the upper platform surface 18. With the telescoping hood engaged, as shown at the left section view in FIG. 1, room air will travel by natural convection within the aperture 28, and will form a film of cooling air along the inner surface of the downwardly open hood 2 and the inner surface of the stackpipe 8. All combustion products and inducted room air through aperture 28 will flow upwardly for eventual discharge through the stationary smoke pipe 4, without escaping into the surrounding room area. Combustion products are contained within the stationary smoke pipe 4 due to a novel sealing engagement as defined between the lower extension of the stationary smoke pipe 4, and the concentrically disposed inner and outer stackpipes 8 and 6, respectively. The downwardly open hood portion 2 extends directly from a sealing engagement with the inner stackpipe 8, and is in further sealing engagement with a bottom surface of the outer stackpipe 6. There is thusly defined a double-wall construction for the telescoping hood, with this double-wall construction being substantially occupied by the lowermost portions of the stationary smoke pipe 4. This interengagement makes the annular space between the inner and outer stackpipes function as a labryinth seal insofar as any combustion products would necessarily travel a tortuous passage around the bottom of the stationary smoke pipe in order to escape into the room.

In order to allow a maximum travel for the vertically telescoping hood 2, a damper 14 is shown positioned proximate the intersection of the bottom surface of the inner stackpipe 8, and the downwardly extending hood portion at 2. Damper 14 is illustrated to be pivotable upon a laterally extending shaft 10, which includes an appropriate bearing surface in both the inner and outer stackpipes. A conventional damper handle 12 is illustrated for adjusting the vertical orientation of the damper valve 14. It should be noted that the downwardly extending portion of the hood, at 2, may either be symmetrical with respect to the stationary smoke pipe 4 or be of any pleasing external configuration. In the preferred embodiment of FIG. 1, the downwardly open hood is illustrated to be circular, though it may be square, rectangular, hexagonal, or any other symmetrical or asymmetrical shape.

Figure 2:
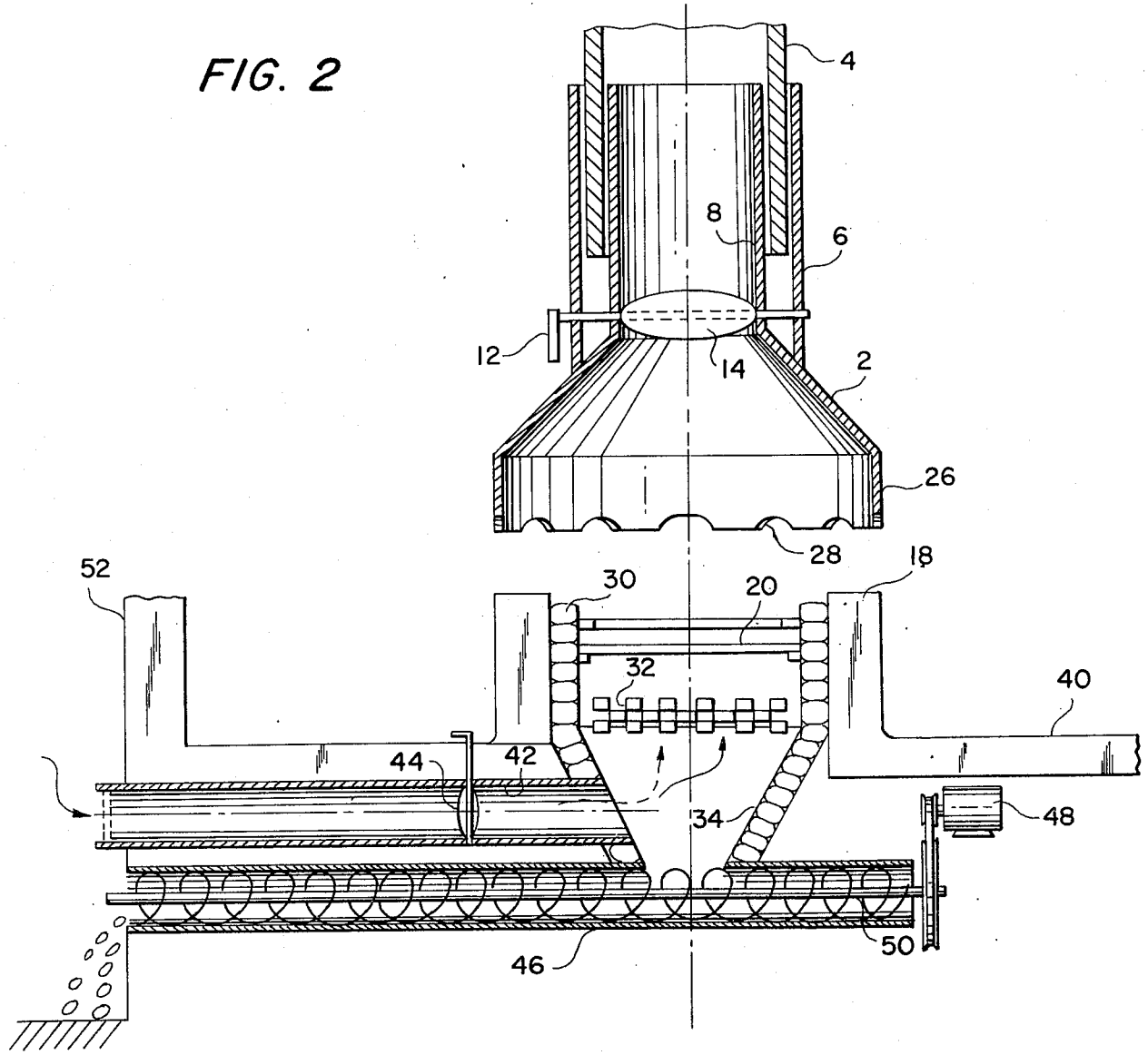
FIG. 2 is a schematic plan view of the invention, illustrating additional and optional features.

FIG. 2 illustrates a further optional construction for supplying ambient air to the upwardly open plenum 34 within the fireplace base. In the embodiment of FIG. 2, there is a particular form of ambient air conduit means 42, further provided with a regulating damper valve 44. In FIG. 2 the upwardly open plenum is illustrated to be in the form of an inverted conical section, with the further provision of an ash removal means at its lowermost portion. In the embodiment of FIG. 2, the ambient air conduit 42 is shown operably disposed below the floor surface 40 within which the fireplace base is operably mounted. The ambient air conduit 42 may communicate ambient air within the base of the fireplace from any ambient air region, and preferably from an ambient air region which is external to a room in which the fireplace is located. In FIG. 2 the ambient air conduit 42 is shown open through an external wall of the building 42, inside of which the fireplace structure is located. The additional feature of an ash removal conduit is also illustrated in FIG. 2, at 46. The ash removal conduit 46 is illustrated to include an auger 50 horizontally disposed within the laterally extending ash removal conduit 46, with a portion of the conduit 46 being upwardly open for communicating with the lowermost portion of the plenum 34. In FIG. 2, a drive means 48 for the auger 50 is illustrated to enable ashes falling down from the grate means at 32 to be conveniently disposed of to an external point of deposit.

In FIG. 3 a vertical section view of a preferred embodiment for a plenum 34 is further illustrated. The plenum 34 is illustrated as a inverted conical section with an ambient air inlet 54 communicating with a bottom portion of the plenum 34. While the ambient air inlet 54 is illustrated as a circular conduit, any other shape of conduit or air inlet manifold may be used, so that ambient air is introduced for an upward diffusion past the fire grating means 32. The inverted conical section illustrated in FIG. 3 allows for a particularly effecient collection of ashes by the ash removal circuit 46, as they fall by gravity from the fire grating means 32.

A lifting mechanism for raising and lowering the telescoping hood 2 is illustrated, according to a preferred embodiment in FIGS. 4 and 5. As shown in FIG. 4, a pair of chains 56 and 58, are shown downwardly suspended from a point proximate with the ceiling 66 of a room wherein the present invention is employed. The first chain 56 is shown downwardly disposed from a point proximate the stationary smoke pipe, with the second chain 58 being diametrically disposed with respect to the stationary smoke pipe. Each chain has a distal end connected externally to the telescoping hood, and a proximate end which is connected to a sprocket drive means. The sprocket drive means is illustrated in FIG. 4 to comprise a first sprocket 72 which engages the first chain 56, and a second sprocket 74 which engages the second chain 58. The sprocket drive means may further comprise a drive shaft 78 which may either be manually or motor driven, as represented by the rotational arrow in FIG. 4.

The preferred lifting mechanism, according to the present invention, is further illustrated in FIG. 5 to include a pair of diametrically opposed idle sprockets which may be ceiling mounted proximate the stationary smoke pipe. The first chain 56 is shown to begin its downward extension by support upon a idler sprocket 62 which is preferably suspended from the ceiling 66 by a first support 68. In like fashion, the second chain 58 is shown to define its downward extension by a second idler sprocket 64 which is suspended from a second ceiling support 70, also diametrically opposed to the first support 68. Any manner may be employed to secure the chains 56 and 58, respectively, to the telescoping hood, and externally mounted hooks are illustrated in FIG. 5. While two downwardly extended chains 56 and 58 are illustrated, there are other forms of actuation which may be used to accomplish the vertical positioning of the telescoping hood 2. The upper edge of the external stackpipe 6 may also remain above the ceiling line 66, for all vertical positions of the hood, if a clearance space around the smoke pipe 4 is provided, as shown in FIG. 5.

From the foregoing, various other features, advantages, objectives, adaptations and rearrangements of the disclosed invention will be apparent to one skilled in the art, however, it is understood that the invention itself is solely to be limited by the scope of the appended claims.

I claim:

1. An improved fireplace comprising, in combination:

A. a fire support means operable for supporting a fire, including a fireplace base operable to be mounted upon a floor surface and air conduit means within said base for supplying ambient air to the bottom of said fireplace base, and;

B. a stationary smokepipe operable to be mounted above and in substantial vertical alignment with said fire support means, said stationary smokepipe extending downwardly to a point spaced above an upper platform on said fireplace base, and;

C. a telescoping hood means, positioned for vertical movement upon the downward extension of said stationary smokepipe, said hood means further comprising an inner stackpipe, concentrically within, and an outer stackpipe, concentrically outside, said smoke pipe with a downwardly open hood extending from said inner stackpipe, wherein said hood is in sealing engagement with bottom surfaces of said inner and outer stackpipes and defines an annular space between the inner and outer stack pipes which space is substantially occupied by the stationary smoke pipe to define a labyrinth seal while it is operable to be adjustably positioned between said upper platform and said point spaced thereabove, wherein said downwardly opening hood further includes a lower edge operable for engaging the upper platform on said fireplace base, and said lower edge includes at least one aperture operable to allow room air to enter within said hood when said hood is lowered upon said upper platform.

2. An improved fireplace according to claim 1, wherein said fire support means further comprises an upwardly opening plenum, within said base, with a bottom portion of said plenum communicating with said ambient air conduit means, and a top portion including grating means for supporting a combustible material.

3. An improved fireplace according to claim 2, wherein said upwardly opening plenum is in the form of an inverted conical section.

4. An improved fireplace according to claim 2, wherein said upwardly opening plenum includes an ash removal means at its lowermost portion, below said air conduit means.

5. An improved fireplace according to claim 1, wherein said hood is substantially symmetrical with respect to said stationary smokepipe.

6. An improved fireplace according to claim 1, wherein said ambient air conduit means further comprises a conduit operable to be disposed below said floor surface for communicating into said fireplace base ambient air which is external to a room in which said fireplace is located.

7. An improved fireplace according to claim 6, wherein said ambient air is supplied by an air conduit operable to open through an external wall of a building inside which said fireplace is located.

8. An improved fireplace according to claim 6, wherein said telescoping hood means further includes a lifting mechanism operable to be located proximate a ceiling of said room, wherein said telescoping hood may be vertically positioned upon said stationary smokepipe by said lifting mechanism.

9. An improved fireplace according to claim 8, wherein said lifting mechanism further comprises a pair of chains downwardly suspended, diametrically and proximate with respect to said stationary smokepipe, each chain having a distal end connected externally to said hood and a proximate end connected to a sprocket drive means.

10. An improved fireplace according to claim 9, wherein said sprocket drive means comprises an electrically actuated motor.

11. An improved fireplace according to claim 9, wherein said sprocket drive means comprises a manually rotatable drive shaft.

12. An improved fireplace according to claim 4, wherein said ash removal means further comprises a laterally extending ash conduit operable to be disposed below said floor surface, and an auger within said ash conduit, wherein said conduit includes an upwardly open portion communicating with the lowermost portion of said plenum.

13. An improved fireplace according to claim 2, wherein said grating means further comprises a plurality of firebrick, laterally and vertically spaced, to define updraft passages for said ambient air.

14. An improved fireplace according to claim 1, wherein a damper is horizontally disposed within said inner stackpipe.

15. An improved fireplace according to claim 14, wherein said damper is disposed proximate the engagement of the bottom surface of said inner stackpipe and said downwardly open hood.

16. An improved fireplace according to claim 2, wherein the top portion of said plenum further includes a grill means, operable to be positioned above said grating means, for the purpose of allowing for grilling items over said combustible material.

* * * * *